US008728172B2

(12) United States Patent
Corona, III et al.

(10) Patent No.: US 8,728,172 B2
(45) **Date of Patent: *May 20, 2014**

(54) COMPOSITIONS AND METHODS FOR PROVIDING A BENEFIT

(75) Inventors: Alessandro Corona, III, Mason, OH (US); Brian W. Everingham, Cincinnati, OH (US); Gayle Marie Frankenbach, Cincinnati, OH (US); Heidi Hsieh, Forest Park, OH (US); Rajan Keshav Panandiker, West Chester, OH (US); Brian Joseph Roselle, Fairfield, OH (US); Beth Ann Schubert, Maineville, OH (US); Mark Robert Sivik, Mason, OH (US); Kerry Andrew Vetter, Cincinnati, OH (US); Gregory Thomas Waning, Fairfield, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/052,326

(22) Filed: Mar. 21, 2011

(65) Prior Publication Data

US 2011/0162154 A1 Jul. 7, 2011

Related U.S. Application Data

(62) Division of application No. 12/549,422, filed on Aug. 28, 2009, now abandoned.

(60) Provisional application No. 61/092,640, filed on Aug. 28, 2008, provisional application No. 61/221,632, filed on Jun. 30, 2009.

(51) Int. Cl.

| | |
|---|---|
| ***B08B 3/04*** | (2006.01) |
| ***C11D 1/02*** | (2006.01) |
| ***C11D 1/38*** | (2006.01) |

(52) U.S. Cl.

USPC ..... 8/137; 510/276; 510/330; 510/426; 510/475; 510/504

(58) Field of Classification Search

USPC ..... 8/137; 510/276, 330, 426, 475, 504

See application file for complete search history.

(56) References Cited

U.S. PATENT DOCUMENTS

| | | | |
|---|---|---|---|
| 3,549,546 | A | 12/1970 | Moore |
| 3,943,255 | A | 3/1976 | Newkirk |
| 4,622,161 | A | 11/1986 | Cornelissens et al. |
| 4,634,544 | A | 1/1987 | Weber et al. |
| 4,806,522 | A | 2/1989 | Sprecker |
| 5,476,660 | A | 12/1995 | Somasundaran et al. |
| 5,529,696 | A | 6/1996 | Tibbitts |
| 5,573,709 | A | 11/1996 | Wells |
| 5,814,596 | A | 9/1998 | Aouad et al. |
| 5,904,735 | A | 5/1999 | Gutierrez et al. |
| 5,955,415 | A | 9/1999 | Gutierrez et al. |
| 6,156,720 | A | 12/2000 | Boeckh et al. |
| 6,255,271 | B1 | 7/2001 | Carswell et al. |
| 6,277,810 | B2 | 8/2001 | Baines et al. |
| 6,300,304 | B1 | 10/2001 | Boeckh et al. |
| 6,569,823 | B2 | 5/2003 | Mooney |
| 6,573,229 | B2 | 6/2003 | Creeth et al. |
| 6,576,228 | B1 | 6/2003 | Crookham et al. |
| 6,620,209 | B2 | 9/2003 | Kischkel et al. |
| 6,740,633 | B2 | 5/2004 | Nörenberg et al. |
| 6,846,797 | B1 | 1/2005 | Parker |
| 6,894,017 | B2 | 5/2005 | Brouwn et al. |
| 6,903,064 | B1 | 6/2005 | Kasturi et al. |
| 6,908,490 | B2 | 6/2005 | Boeckh et al. |
| 6,949,498 | B2 | 9/2005 | Murphy et al. |
| 7,012,054 | B2 | 3/2006 | Binder et al. |
| 7,074,750 | B2 | 7/2006 | Hamers et al. |
| 7,091,167 | B2 | 8/2006 | Lang et al. |
| 7,141,077 | B2 | 11/2006 | Detering et al. |
| 7,304,026 | B2 | 12/2007 | Heibel et al. |
| 2001/0034316 | A1 | 10/2001 | Carswell et al. |
| 2001/0051142 | A1 | 12/2001 | Duden et al. |
| 2002/0010121 | A1 | 1/2002 | Van Deurzen et al. |
| 2002/0010124 | A1 | 1/2002 | Creeth et al. |
| 2002/0055451 | A1 | 5/2002 | Kischkel et al. |
| 2002/0058604 | A1 | 5/2002 | Kischkel et al. |
| 2003/0104964 | A1 | 6/2003 | Cooper et al. |
| 2003/0109400 | A1 | 6/2003 | Murphy et al. |

(Continued)

FOREIGN PATENT DOCUMENTS

| | | |
|---|---|---|
| CA | 2 177 125 | 12/1996 |
| CA | 2 307 429 A1 | 11/2000 |

(Continued)

OTHER PUBLICATIONS

International Search Report for PCT/US2009/054822 mailed Dec. 3, 2009, 6 pages.

International Search Report for PCT/US2009/054716 mailed Nov. 18, 2009, 4 pages.

International Search Report for PCT/US2009/061424 mailed Feb. 5, 2010, 4 pages.

International Search Report for PCT/US2009/061425 mailed Apr. 7, 2010, 4 pages.

U.S. Appl. No. 12/549,418, filed Aug. 28, 2009, Corona, III et al.

U.S. Appl. No. 12/549,413, filed Aug. 28, 2009, Corona, III et al.

U.S. Appl. No. 12/549,712, filed Aug. 28, 2009, Corona, III et al.

U.S. Appl. No. 12/549,422, filed Aug. 28, 2009, Corona, III et al.

*Primary Examiner* — Brian P Mruk

(74) *Attorney, Agent, or Firm* — Melissa G. Krasovec; Steven W. Miller

(57) ABSTRACT

Compositions and methods useful for providing one or more benefits, including a color rejuvenation and/or color maintenance benefit to a fabric are disclosed. The disclosed compositions contain at least one cationic polymer. The methods include providing the disclosed compositions in combination with a source of anionic surfactant. Unit dose and multi-compartment systems are also disclosed.

20 Claims, No Drawings

(56) References Cited

U.S. PATENT DOCUMENTS

| | | | | |
|---|---|---|---|---|
| 2003/0192130 | A1 | 10/2003 | Kaaret et al. | |
| 2004/0023836 | A1 | 2/2004 | Moorfield et al. | |
| 2004/0033924 | A1 | 2/2004 | Murphy et al. | |
| 2004/0063597 | A1 | 4/2004 | Adair et al. | |
| 2004/0071742 | A1 | 4/2004 | Popplewell et al. | |
| 2004/0071746 | A1 | 4/2004 | Popplewell et al. | |
| 2004/0092425 | A1 * | 5/2004 | Boutique et al. | 510/466 |
| 2004/0139559 | A1 | 7/2004 | Detering et al. | |
| 2004/0152616 | A1 | 8/2004 | Murphy et al. | |
| 2005/0028293 | A1 | 2/2005 | Geffroy | |
| 2005/0097678 | A1 | 5/2005 | Geffroy | |
| 2005/0101505 | A1 | 5/2005 | Wood | |
| 2005/0153865 | A1 | 7/2005 | Detering et al. | |
| 2005/0158489 | A1 | 7/2005 | Nagata et al. | |
| 2005/0159330 | A1 | 7/2005 | Shah et al. | |
| 2005/0166333 | A1 | 8/2005 | Kaaret et al. | |
| 2006/0003913 | A1 | 1/2006 | Boutique et al. | |
| 2006/0021150 | A1 | 2/2006 | Hu et al. | |
| 2006/0030513 | A1 | 2/2006 | Binder et al. | |
| 2006/0058214 | A1 | 3/2006 | Zhang et al. | |
| 2006/0074005 | A1 | 4/2006 | Kischkel et al. | |
| 2006/0154836 | A1 | 7/2006 | Sengupta et al. | |
| 2006/0183662 | A1 | 8/2006 | Crotty et al. | |
| 2006/0217288 | A1 | 9/2006 | Wahl et al. | |
| 2006/0276370 | A1 | 12/2006 | Zhang et al. | |
| 2006/0287216 | A1 | 12/2006 | Song | |
| 2007/0027050 | A1 | 2/2007 | Crotty et al. | |
| 2007/0060489 | A1 | 3/2007 | Sun et al. | |
| 2007/0190009 | A1 | 8/2007 | Guentert et al. | |
| 2007/0277327 | A1 | 12/2007 | Wessling et al. | |
| 2007/0292380 | A1 | 12/2007 | Staudigel et al. | |
| 2008/0096788 | A1 | 4/2008 | Lang | |
| 2008/0103080 | A1 | 5/2008 | Lang | |
| 2008/0103081 | A1 | 5/2008 | Lang | |
| 2008/0131390 | A1 | 6/2008 | Lang | |
| 2009/0036339 | A1 | 2/2009 | Sans et al. | |
| 2009/0048137 | A1 | 2/2009 | Lang | |
| 2010/0105592 | A1 | 4/2010 | Yoda et al. | |

FOREIGN PATENT DOCUMENTS

| | | | | |
|---|---|---|---|---|
| DE | 35 31 756 | A | 3/1986 | |
| DE | 101 16 491 | A1 | 4/2001 | |
| DE | 100 64 635 | A1 | 7/2002 | |
| DE | 10 2004 051 715 | A1 | 10/2004 | |
| DE | 10 2005 039 168 | | 8/2005 | |
| EP | 0 264 710 | A1 | 4/1988 | |
| EP | 1 114 139 | B1 | 2/2005 | |
| EP | 1 146 110 | B1 | 11/2005 | |
| GB | 2 164 657 | A | 3/1986 | |
| GB | 2163771 | * | 3/1986 | C11D 1/835 |
| JP | 04050374 | | 2/1992 | |
| JP | 11 148093 | | 6/1999 | |
| JP | 2000-272234 | A | 10/2000 | |
| JP | P2001-107083 | A | 4/2001 | |
| JP | P2002-60788 | A | 2/2002 | |
| JP | P2002-60789 | A | 2/2002 | |
| JP | P2002-60791 | A | 2/2002 | |
| JP | P2002-60800 | A | 2/2002 | |
| JP | P2006-22203 | A | 1/2006 | |
| JP | P2007-31900 | A | 2/2007 | |
| WO | WO 00/17297 | | 3/2000 | |
| WO | WO 2006/042716 | A1 | 4/2006 | |
| WO | WO 2006/042717 | A1 | 4/2006 | |
| WO | WO 2006/086811 | | 8/2006 | |
| WO | WO 2006/088980 | * | 8/2006 | C11D 3/37 |
| WO | WO 2006/134044 | A1 | 12/2006 | |
| WO | WO 2007/107215 | A1 | 9/2007 | |

* cited by examiner

COMPOSITIONS AND METHODS FOR PROVIDING A BENEFIT

CROSS REFERENCE TO RELATED APPLICATION

This application is a Divisional application of U.S. application Ser. No. 12/549,422, filed Aug. 28, 2009, now abandoned, which claims priority to U.S. Provisional Application Ser. No. 61/092,440 filed Aug. 28, 2008, and U.S. Provisional Application Ser. No. 61/221,632 filed Jun. 30, 2009.

FIELD OF THE INVENTION

Compositions and methods for providing a benefit to a fabric are disclosed.

BACKGROUND OF THE INVENTION

Depending on the fabric type, colored garments are prone to fading and color loss as a result of normal wear and laundering conditions, resulting in non-use of the garments and/or consumer dissatisfaction. Dark colors may be particularly susceptible to fading or loss of color. One means of restoring color to faded or worn fabrics is via the use of dyes. While dye compositions may be used to restore colored, faded or worn fabrics, such compositions generally require complex steps and are messy to use. Re-dying also requires color matching of the fabric, which can be difficult in many cases. Accordingly, it may be desirable to provide color restoration without the need for dyes.

Cationic polymers, at higher concentrations, generally do not formulate well with anionic surfactants due to their positive charge. Such polymers tend to interact with anionic surfactants, and thus, tend to form an unpourable, phase-separated mixture. Such mixtures are generally incompatible with consumer use.

As such, the use and formulation of compositions capable of providing a benefit to fabrics in a laundering process, which comprise higher levels of cationic polymers tends to be limited by formulation and stability concerns. Accordingly, there remains a need for compositions and/or methods by which cationic polymers can be delivered to a fabric to impart a benefit—such as a color care benefit—while avoiding the formulation problems described above.

SUMMARY OF THE INVENTION

Compositions and methods for providing a benefit to a fabric are disclosed.

DETAILED DESCRIPTION OF THE INVENTION

A. Definitions

As used herein, the articles "a" and "an" when used in a claim, are understood to mean one or more of what is claimed or described.

As used herein, the term "additive" means a composition or material that may be used separately from (but including before, after, or simultaneously with) the detergent during any step of a laundering process to impart a benefit to a fabric.

As used herein, the term "Anionic Charge Density (ACD) per use" means the amount of negative charge present in a volume of a single dose of the composition to be dispensed. By way of example, assuming a detergent dose of 78 g, that contains 22.2% of a surfactant having a molecular weight of 390 g/mol, the ACD is calculated as follows: 78 g×0.222=17.3 g/dose anionic surfactant; 1 negative charge per mol or 1 equivalent charge for anionic surfactant=ACD of 17.3×1/390×1000=44.3 meq anionic charge per dose.

As used herein, the term "black" as applied to a garment, is defined as the color measured by Hunter L with an L value range from 0 to about 18, or about 16 or less. Fabric manufacturers use other techniques to assess "black" that include the Pantone Matching System. The Pantone Matching System is an established palette of colors that can be accessed from Pantone at www.pantone.com. An example of a black color specification palette number 19-4005 tc used as black for the black T-shirt manufactured and sold by the Gildan fabric company, 600 de Maisonneuve West, 33rd Floor, Montreal (Quebec), H3A 3J2 Canada. This color also corresponds in the CMYK Color Model of 100-35-0-100 wherein CMYK is defined as C for cyan, M for magenta, Y for yellow, and K is key for black. The CMYK ISO standard is ISO 12640-1: 1997 and can be accessed at www.iso.org.

As used herein, the term "cationic polymer" means a polymer having a net cationic charge.

As used herein, the term "coacervate" means a particle formed from the association of a cationic polymer and an anionic surfactant in an aqueous environment. The term "coacervate" may be used interchangeably with the terms "primary particle," "colloidal particle," and "aggregate particle."

As used herein, the term "colloidal particle" means an aggregation of primary particles.

As used herein, the term "comprising" means various components conjointly employed in the preparation of the compositions of the present disclosure. Accordingly, the terms "consisting essentially of" and "consisting of" are embodied in the term "comprising".

As used herein, "conventional detergent" means a composition comprising a detersive agent, such as an anionic surfactant.

As used herein, "charge density" refers to the charge density of the polymer itself and may be different from the monomer feedstock. Charge density may be calculated by dividing the number of net charges per repeating unit by the molecular weight of the repeating unit. The positive charges may be located on the backbone of the polymers and/or the side chains of polymers. For polymers with amine monomers, the charge density depends on the pH of the carrier. For these polymers, charge density is measured at a pH of 7. ACD refers to anionic charge density, while CCD refers to cationic charge density.

As used herein, the term "Cationic Charge Density (CCD) per use" means the amount of positive charge present in a volume of a single dose of the composition to be dispensed. By way of example, assuming a detergent dose of 78 g, that contains 4% of a cationic polymer having a molecular weight of 150,000 Daltons and a monomer molecular weight of 161.67 g/mol, the CCD is calculated as follows: polymer charge density is 1/161.67×1000 or 6.19 meq/g, and the CCD 78 g×0.04×6.19, or 19.3 meq per dose.

As used herein, the term "cationic polymer" means a polymer having a net cationic charge.

As used herein, the term "dry" as applied to a fabric, means having about 14% residual moisture.

As defined herein, "essentially free of a component" means that no amount of that component is deliberately incorporated into the composition.

As used herein, "composition" includes fabric care compositions for handwash, machine wash and/or other purposes and includes fabric care additive compositions and compositions suitable for use in the soaking and/or pretreatment of fabrics. They may take the form of, for example, laundry detergents, fabric conditioners and/or other wash, rinse, dryer added products, and sprays. Compositions in the liquid form are generally in an aqueous carrier. In other aspects, the compositions may be in the form of a granular detergent or dryer added fabric softener sheet. The term includes, unless otherwise indicated, granular or powder-form all-purpose or "heavy-duty" washing agents, especially cleaning detergents; liquid, gel or paste-form all-purpose washing agents; liquid fine-fabric detergents; cleaning auxiliaries such as bleach additives and "stain-stick" or pre-treat types, substrate-laden products, dry and wetted wipes and pads, nonwoven substrates, and sponges; and sprays and mists. In some aspects, the composition may be a compacted formulation having a low water content, for example less than 50%, less than 30%, less than 15%, or less than 10% water or other carrier.

As used herein, "high charge density" means a charge density of greater than about 1 meq/g. "Low charge density" means a charge density of less than about 1 meq/g.

As used herein, the phrase "high molecular weight" means a molecular weight of greater than about 1,000,000 kD. The phrase "low molecular weight" means a molecular weight of from about 1,000 to about 500,000 kD.

As used herein, the "L*C*h color space" and "L*a*b* color space" are three dimensional colorimetric models developed by Hunter Associates Laboratory and recommended by the Commission Internationale d'Eclairage ("CIE") to measure the color or change in color of a dyed article. The CIE L*a*b* color space ("CIELAB") has a scale with three-fold axes with the L axis representing the lightness of the color space (L*=0 for black, L*=100 for white), the a* axis representing color space from red to green (a*>0 for red, a*<0 for green) and the b* axis representing color space from yellow to blue (b*>0 for yellow, b*<0 for blue). The L*C*h color space is an approximately uniform scale with a polar color space. The CIE L*C*h color space ("CIELCh") scale values are determined instrumentally and may also be calculated from the CIELAB scale values. As used herein, the $DE^*_{CMC}$ value includes the vector associated with the distance in the L*C*h space between the initial L*C*h value and the final L*C*h value. As used herein the DE* value includes the vector associated with the distance in the L*a*b* space between the initial L*a*b* value and the final L*a*b*. The L* lightness value is the same for both the CIELCh and CIELAB color scales. The C* value (chroma value) and the h value (hue angle) may be calculated from the a* and b* values of the CIELAB scale. All colors may be represented by a coordinate in the L*a*b* color space and changes in colors may be represented by the vector corresponding to the coordinate difference between an initial color and a final color. Term definitions and equation derivations are available from Hunter Associates Laboratory, Inc. and from www.hunterlab.com, and are incorporated in their entirety by reference herein.

As used herein, the terms "rejuvenation" or "restoration" of a fabric mean a benefit wherein a treated fabric has a delta L value, as determined using the Test Methods below, of less than about −0.01. In general, the terms "rejuvenation" or "restoration" mean enhancing or making more vivid or vibrant the appearance of colored or dyed fabrics. The term includes restoring the color appearance of a faded fabric and improving the color appearance of a new or faded fabric to "better than new."

As used herein, the phrase "under wash conditions" means those conditions set forth in the Test Methods herein, entitled "Dilution under Wash Conditions."

As defined herein, "unit dose" means an amount of composition suitable to treat one load of laundry, such as, for example, from about 0.05 g to about 100 g, or from 10 g to about 60 g, or from about 20 g to about 40 g.

Unless otherwise noted, all component or composition levels are in reference to the active portion of that component or composition, and are exclusive of impurities, for example, residual solvents or by-products, which may be present in commercially available sources of such components or compositions.

The Test Methods disclosed in the present application should be used to determine the respective values of the parameters of Applicants' invention.

All measurements are performed at 25° C., unless otherwise specified.

Compositions useful for providing a benefit, particularly a color-care benefit, to a fabric, and methods of providing the same, particularly as a service to a consumer, are disclosed.

Without being limited by theory, Applicants believe that a benefit can be delivered to a garment, particularly a color-care benefit, via the combination of cationic polymer and anionic surfactant. Without being limited by theory, Applicants believe the combination of a cationic polymer and anionic surfactant results in the formation of a coacervate, which interacts with treated fabric, depositing a thin film that coalesces the treated fiber which then decreases topical fuzz. This, in turn, is believed to reduce diffraction of light at the surface of the fabric, resulting in the appearance of a deeper, more true (i.e., unfaded or undamaged) color. Applicants have further recognized that incorporation of silicone materials can improve one or more benefits delivered to a fabric using the disclosed compositions and methods.

Compositions

Compositions comprising, based on total composition weight, from about 0.1% to about 100%, from about 0.5% to about 80%, or from about 1.0% to about 70%, or from about 1.5% to about 60%, or from about 2% to about 50%, or from about 3% to about 40%, or from about 4% to about 30%, or from about 5% to about 20% of a cationic polymer having a charge density of from about 0.05 meq/g to about 25 meq/g, or from about 0.1 to about 12 meq/g, or from about 0.5 to about 7 meq/g, or from about 0.2 to about 3 meq/g at a pH of from about 2 to about 11, or, from about 2.5 to about 9.5 are disclosed.

In one aspect, the cationic polymer may be selected from the group consisting of cationic or amphoteric polysaccharides, polyethyleneimine and its derivatives, a synthetic polymer made by polymerizing one or more cationic monomers selected from the group consisting of N,N-dialkylaminoalkyl acrylate, N,N-dialkylaminoalkyl methacrylate, N,N-dialkylaminoalkyl acrylamide, N,N-dialkylaminoalkylmethacrylamide, quaternized N,N dialkylaminoalkyl acrylate quaternized N,N-dialkylaminoalkyl methacrylate, quaternized N,N-dialkylaminoalkyl acrylamide, quaternized N,N-dialkylaminoalkylmethacrylamide, Methacryloamidopropyl-pentamethyl-1,3-propylene-2-ol-ammonium dichloride, N,N,N,N',N',N'',N''-heptamethyl-N''-3-(1-oxo-2-methyl-2-propenyl)aminopropyl-9-oxo-8-azo-decane-1,4,10-triammonium trichloride, vinylamine and its derivatives, allylamine and its derivatives, vinyl imidazole, quaternized vinyl imidazole and diallyl dialkyl ammonium chloride and combinations thereof. The cationic polymer may optionally comprise a second monomer selected from the group consisting of acrylamide, N,N-dialkyl acrylamide, methacrylamide, N,N-dialkylmethacrylamide, $C_1$-$C_{12}$ alkyl acrylate, $C_1$-$C_{12}$ hydroxyalkyl acrylate, polyalkylene glyol acrylate, $C_1$-$C_{12}$ alkyl methacrylate, $C_1$-$C_{12}$ hydroxyalkyl methacrylate, polyalkylene glycol methacrylate, vinyl acetate, vinyl alcohol, vinyl formamide, vinyl acetamide, vinyl alkyl ether, vinyl pyridine, vinyl pyrrolidone, vinyl imidazole, vinyl caprolactam, and derivatives, acrylic acid, methacrylic acid, maleic acid, vinyl sulfonic acid, styrene sulfonic acid, acrylamidopropylmethane sulfonic acid (AMPS) and their salts. The polymer may be a terpolymer made from more than two monomers. The polymer may optionally be branched or cross-linked by using branching and crosslinking monomers. Branching and crosslinking monomers include ethylene glycoldiacrylate divinylbenzene, and butadiene. In one aspect, the cationic polymer may include those produced by polymerization of ethylenically unsaturated monomers using a suitable initiator or catalyst, such as those disclosed in WO 00/56849 and U.S. Pat. No. 6,642,200. In one aspect, the cationic polymer may comprise charge neutralizing anions such that the overall polymer is neutral under ambient conditions. Suitable counter ions include (in addition to anionic species generated during use) include chloride, bromide, sulfate, methylsulfate, sulfonate, methylsulfonate, carbonate, bicarbonate, formate, acetate, citrate, nitrate, and mixtures thereof.

In one aspect, the cationic polymer may be selected from the group consisting of poly(acrylamide-co-diallyldimethylammonium chloride), poly(acrylamide-methacrylamidopropyltrimethyl ammonium chloride), poly(acrylamide-co-N,N-dimethyl aminoethyl acrylate) and its quaternized derivatives, poly(acrylamide-co-N,N-dimethyl aminoethyl methacrylate) and its quaternized derivative, poly(hydroxyethylacrylate-co-dimethyl aminoethyl methacrylate), poly (hydroxpropylacrylate-co-dimethyl aminoethyl methacrylate), poly(hydroxpropylacrylate-co-methacrylamidopropyltrimethylammonium chloride), poly (acrylamide-co-diallyldimethylammonium chloride-co-acrylic acid), poly(acrylamide-methacrylamidopropyltrimethyl ammonium chloride-co-acrylic acid), poly(diallyldimethyl ammonium chloride), poly(vinylpyrrolidone-co-dimethylaminoethyl methacrylate), poly(ethyl methacrylate-co-quaternized dimethylaminoethyl methacrylate), poly(ethyl methacrylate-co-oleyl methacrylate-co-diethylaminoethyl methacrylate), poly(diallyldimethylammonium chloride-co-acrylic acid), poly(vinyl pyrrolidone-co-quaternized vinyl imidazole) and poly (acrylamide-co-methacryloamidopropyl-pentamethyl-1,3-propylene-2-ol-ammonium dichloride). These cationic polymers may include and may be described by the nomenclature Polyquaternium-1, Polyquaternium-5, Polyquaternium-6, Polyquaternium-7, Polyquaternium-8, Polyquaternium-11, Polyquaternium-14, Polyquaternium-22, Polyquaternium-28, Polyquaternium-30, Polyquaternium-32 and Polyquaternium-33, as named under the International Nomenclature for Cosmetic Ingredients.

In one aspect, the cationic polymer may comprise a cationic acrylic based polymer. In one aspect, the cationic polymer may comprise a cationic polyacrylamide. In one aspect, the cationic polymer may comprise poly(acrylamide-N,N-dimethylaminoethyl acrylate) and its quaternized derivatives. In this aspect, the cationic polymer may be that sold under the tradename Sedipur®, available from BTC Specialty Chemicals, BASF Group, Florham Park, N.J.

In one aspect, the cationic polymer may comprise poly (acrylamide-co-methacrylamidopropyltrimethyl ammonium chloride).

In one aspect, the cationic polymer may comprise a non-acrylamide based polymer, such as that sold under the tradename Rheovis® CDE, available from Ciba Specialty Chemicals, a BASF group, Florham Park, N.J., or as disclosed in USPA 2006/0252668 A1.

In one aspect, the cationic polymer may comprise polyethyleneimine or a polyethyleneimine derivative. In one aspect, the cationic polymer may be a polyethyleneinine such as that sold under the tradename Lupasol® by BASF, AG, Lugwigschaefen, Germany In one aspect, the cationic polymer may include alkylamine-epichlorohydrin polymers, which are reaction products of amines and oligoamines with epicholorohydrin. These include those polymers listed in U.S. Pat. Nos. 6,642,200 B1 and 6,551,986 B1. Examples include dimethylamine-epichlorohydrin-ethylenediamine, and available under the trade name Cartafix® CB and Cartafix® TSF from Clariant, Basle, Switzerland.

In one aspect, the cationic polymer may comprise a synthetic cationic polymer comprising polyamidoamine-epichlorohydrin (PAE) resins of polyalkylenepolyamine with polycarboxylic acid. The most common PAE resins are the condensation products of diethylenetriamine with adipic acid followed by a subsequent reaction with epichlorohydrin. They are available from Hercules Inc. of Wilmington Del. under the trade name Kymene™ or from BASF AG (Ludwigshafen, Germany) under the trade name Luresin™. These polymers are described in Wet Strength resins and their applications edited by L. L. Chan, TAPPI Press (1994), at pp. 13-44.

In one aspect, the cationic polymer may be selected from the group consisting of cationic or amphoteric polysaccharides. In one aspect, the cationic polymer may comprise a polymer selected from the group consisting of cationic and amphoteric cellulose ethers, cationic or amphoteric galactomanan, cationic guar gum, cationic or amphoteric starch, and combinations thereof.

In one aspect, the cationic polymer may comprise an amphoteric polymer, provided the polymer possesses a net positive charge. In one aspect, the amphoteric polymer may have a cationic charge density of about 0.05 to about 18 milliequivalents/g.

In one aspect, the cationic polymer may have a weight-average molecular weight of from about 500 to about 5,000,000 or from about 1,000 to about 2,000,000 or from about 2,500 to about 1,500,000 Daltons as determined by size exclusion chromatography relative to polyethyleneoxide standards with RI detection. In one aspect, the molecular weight of the cationic polymer may be from about 500 to about 37,500 kD. In one aspect, the one or more cationic polymer may have a weight-average molecular weight of 500 Daltons to about 37,500 Daltons and a charge density of from about 0.1 meq/g to about 12.

In one aspect, the composition may comprise, based on total composition, weight from about 0.1% to about 30%, from about 0.5% to about 20%, from about 1.0% to about 10%, or from about 1.5% to about 8% of an organosilicone.

Suitable organosilicones comprise Si—O moieties and may be selected from (a) non-functionalized siloxane polymers, (b) functionalized siloxane polymers, and combinations thereof. The molecular weight of the organosilicone is usually indicated by the reference to the viscosity of the material. In one aspect, the organosilicones may comprise a viscosity of from about 10 to about 2,000,000 centistokes at 25° C. In one aspect, suitable organosilicones may have a viscosity of from about 10 to about 800,000 centistokes at 25° C.

Suitable organosilicones may be linear, branched or cross-linked. In one aspect, the organosilicones may be linear.

In one aspect, the organosilicone may comprise a non-functionalized siloxane polymer that may have Formula I below, and may comprise polyalkyl and/or phenyl silicone fluids, resins and/or gums.

$$[R_1R_2R_3SiO_{1/2}]_n[R_4R_4SiO_{2/2}]_m[R_4SiO_{3/2}]_j \quad \text{(Formula I)}$$

wherein:

i) each $R_1$, $R_2$, $R_3$ and $R_4$ may be independently selected from the group consisting of H, —OH, $C_1$-$C_{20}$ alkyl, $C_1$-$C_{20}$ substituted alkyl, $C_6$-$C_{20}$ aryl, $C_6$-$C_{20}$ substituted aryl, alkylaryl, and/or $C_1$-$C_{20}$ alkoxy, moieties;

ii) n may be an integer from about 2 to about 10, or from about 2 to about 6; or 2; such that n=j+2;

iii) m may be an integer from about 5 to about 8,000, from about 7 to about 8,000 or from about 15 to about 4,000;

iv) j may be an integer from about 0 to about 10, or from about 0 to about 4, or 0;

In one aspect, $R_2$, $R_3$ and $R_4$ may comprise methyl, ethyl, propyl, $C_4$-$C_{20}$ alkyl, and/or $C_6$-$C_{20}$ aryl moieties. In one aspect, each of $R_2$, $R_3$ and $R_4$ may be methyl. Each $R_1$ moiety blocking the ends of the silicone chain may comprise a moiety selected from the group consisting of hydrogen, methyl, methoxy, ethoxy, hydroxy, propoxy, and/or aryloxy.

As used herein, the nomenclature SiO"n"/2 represents the ratio of oxygen and silicon atoms. For example, $SiO_{1/2}$ means that one oxygen is shared between two Si atoms. Likewise $SiO_{2/2}$ means that two oxygen atoms are shared between two Si atoms and $SiO_{3/2}$ means that three oxygen atoms are shared are shared between two Si atoms.

In one aspect, the organosilicone may be polydimethylsiloxane, dimethicone, dimethiconol, dimethicone crosspolymer, phenyl trimethicone, alkyl dimethicone, lauryl dimethicone, stearyl dimethicone and phenyl dimethicone. Examples include those available under the trade names DC 200 Fluid, DC 1664, DC 349, DC 346G available from offered by Dow Corning Corporation, Midland, Mich., and those available under the trade names SF1202, SF1204, SF96, and Viscasil® available from Momentive Silicones, Waterford, N.Y.

In one aspect, the organosilicone may comprise a cyclic silicone. The cyclic silicone may comprise a cyclomethicone of the formula $[(CH_3)_2SiO]_n$ where n is an integer that may range from about 3 to about 7, or from about 5 to about 6.

In one aspect, the organosilicone may comprise a functionalized siloxane polymer. Functionalized siloxane polymers may comprise one or more functional moieties selected from the group consisting of amino, amido, alkoxy, hydroxy, polyether, carboxy, hydride, mercapto, sulfate phosphate, and/or quaternary ammonium moieties. These moieties may be attached directly to the siloxane backbone through a bivalent alkylene radical, (i.e., "pendant") or may be part of the backbone. Suitable functionalized siloxane polymers include materials selected from the group consisting of aminosilicones, amidosilicones, silicone polyethers, silicone-urethane polymers, quaternary ABn silicones, amino ABn silicones, and combinations thereof.

In one aspect, the functionalized siloxane polymer may comprise a silicone polyether, also referred to as "dimethicone copolyol." In general, silicone polyethers comprise a polydimethylsiloxane backbone with one or more polyoxyalkylene chains. The polyoxyalkylene moieties may be incorporated in the polymer as pendent chains or as terminal blocks. Such silicones are described in USPA 2005/0098759 A1, and U.S. Pat. Nos. 4,818,421 and 3,299,112. Exemplary commercially available silicone polyethers include DC 190, DC 193, FF400, all available from Dow Corning Corporation, and various Silwet® surfactants available from Momentive Silicones.

In one aspect, the functionalized siloxane polymer may comprise an aminosilicone. Suitable aminosilicones are described in U.S. Pat. Nos. 7,335,630 B2, 4,911,852, and USPA 2005/0170994 A1. In one aspect the aminosilicone may be that described in and cite filed X22 application. In one aspect, the aminosilicone may comprise the structure of Formula II:

$$[R_1R_2R_3SiO_{1/2}]_n[(R_4Si(X—Z)O_{2/2}]_k[R_4R_4SiO_{2/2}]_m [R_4SiO_{3/2}]_j \quad \text{(Formula II)}$$

wherein i. $R_1$, $R_2$, $R_3$ and $R_4$ may each be independently selected from H, OH, $C_1$-$C_{20}$ alkyl, $C_1$-$C_{20}$ substituted alkyl, $C_6$-$C_{20}$ aryl, $C_6$-$C_{20}$ substituted aryl, alkylaryl, and/or $C_1$-$C_{20}$ alkoxy;

ii. Each X may be independently selected from a divalent alkylene radical comprising 2-12 carbon atoms, —$(CH_2)$s- wherein s may be an integer from about 2 to about 10; —$CH_2$—CH(OH)—$CH_2$—; and/or

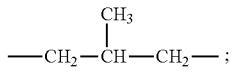

iii. Each Z may be independently selected from —$N(R_5)_2$; —$N(R_5)_3A^-$,

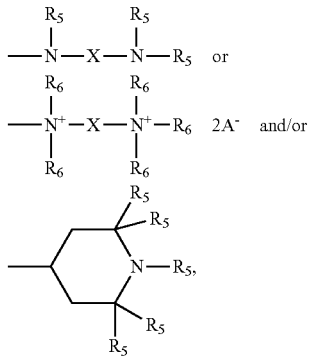

wherein each $R_5$ may be selected independently selected from H, $C_1$-$C_{20}$ alkyl, $C_1$-$C_{20}$ substituted alkyl, $C_6$-$C_{20}$ aryl, $C_6$-$C_{20}$ and/or substituted aryl, each $R_6$ may be independently selected from H, OH, $C_1$-$C_{20}$ alkyl, $C_1$-$C_{20}$ substituted alkyl, $C_6$-$C_{20}$ aryl, $C_6$-$C_{20}$ substituted aryl, alkylaryl, and/or $C_1$-$C_{20}$ alkoxy; and $A^-$ may be a compatible anion. In one aspect, $A^-$ may be a halide;

iv. k may be an integer from about 3 to about 20, or from about 5 to about 18 more or from about 5 to about 10;

v. m may be an integer from about 100 to about 2,000, or from about 150 to about 1,000;

vi. n may be an integer from about 2 to about 10, or about 2 to about 6, or 2, such that n=j+2; and vii. j may be an integer from about 0 to about 10, or from about 0 to about 4, or 0;

In one aspect, $R_1$ may comprise —OH. In this aspect, the organosilicone may be amodimethicone.

Exemplary commercially available aminosilicones include DC 8822, 2-8177, and DC-949, available from Dow Corning Corporation, and KF-873, available from Shin-Etsu Silicones, Akron, Ohio.

In one aspect, the organosilicone may comprise amine ABn silicones and quat ABn silicones. Such organosilicones are generally produced by reacting a diamine with an epoxide. These are described, for example, in U.S. Pat. Nos. 6,903,061 B2, 5,981,681, 5,807,956, 6,903,061 B2 and 7,273,837 B2. These are commercially available under the trade names Magnasoft® Prime, Magnasoft® JSS, Silsoft® A-858 (all from Momentive Silicones).

In one aspect, the functionalized siloxane polymer may comprise silicone-urethanes, such as those described in USPA Ser. No. 61/170,150. These are commercially available from Wacker Silicones under the trade name SLM-21200.

When a sample of organosilicone is analyzed, it is recognized by the skilled artisan that such sample may have, on average, non-integer indices for Formula I and II above, but that such average indice values will be within the ranges of the indices for Formula I and II above.

In one aspect, the compositions may comprise a cationic surfactant. Suitable cationic surfactants may include any cationic surfactants as known in the art, for example, those listed in U.S. Pat. No. 4,259,217.

In one aspect, the composition may comprise one or more adjunct ingredients. Non-limiting list of adjuncts illustrated hereinafter suitable for use in the instant compositions and that may be desirably incorporated in certain aspects are set forth below. In addition to the foregoing adjunct ingredients, suitable examples of other adjuncts and levels of use are found in U.S. Pat. Nos. 5,576,282, 6,306,812 B1 and 6,326,348 B1.

Fatty Acids—The composition may comprise, based on total composition weight, from about 0.01% to about 10%, or from about 2% to about 7%, or from about 3% to about 5%, of a fatty acid containing from about 8 to about 20 carbon atoms. The fatty acid can also contain from about 1 to about 10 ethylene oxide units in the hydrocarbon chain. Suitable fatty acids are saturated and/or unsaturated and can be obtained from natural sources such a plant or animal esters (e.g., palm kernel oil, palm oil, coconut oil, babassu oil, safflower oil, tall oil, castor oil, tallow and fish oils, grease, and mixtures thereof), or synthetically prepared (e.g., via the oxidation of petroleum or by hydrogenation of carbon monoxide via the Fisher Tropsch process). Examples of suitable saturated fatty acids for use in the compositions include captic, lauric, myristic, palmitic, stearic, arachidic and behenic acid. Suitable unsaturated fatty acid species include: palmitoleic, oleic, linoleic, linolenic and ricinoleic acid. Examples of fatty acids are saturated $C_{12}$ fatty acid, saturated $C_{12}$-$C_{14}$ fatty acids, and saturated or unsaturated $C_{12}$ to $C_{18}$ fatty acids, and mixtures thereof.

Brighteners—"Brightener" (also referred to as "optical brightener") is used herein in the broadest sense to include any compound that exhibits fluorescence, including compounds that absorb UV light and reemit as "blue" visible light. In some aspects, brighteners are also low in color or colorless and do not absorb materially in the visible part of the spectrum. In some aspects, brighteners are also light fast, meaning they do not degrade substantially in sunlight.

Chelating Agents—The composition may comprise one or more copper, iron and/or manganese chelating agents. If utilized, chelating agents will generally be present, based on total composition weight, in amounts of from about 0.1% to about 15%, or even from about 3.0% to about 15%.

Dye Transfer Inhibiting Agents—The compositions may comprise one or more dye transfer inhibiting agents. Suitable polymeric dye transfer inhibiting agents include polyvinylpyrrolidone polymers, polyamine N-oxide polymers, copolymers of N-vinylpyrrolidone and N-vinylimidazole, polyvinyloxazolidones and polyvinylimidazoles or mixtures thereof.

Enzymes—Enzymes can be included in the present compositions for a wide variety of fabric laundering purposes including removal of protein-based, carbohydrate-based, or triglyceride-based stains, and/or for fabric restoration. Examples of suitable enzymes include hemicellulases, peroxidases, proteases, cellulases, xylanases, lipases, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, laccase, and known amylases, and combinations thereof. Detersive enzymes are described in greater detail in U.S. Pat. No. 6,579,839. In some aspects, the compositions herein comprise, based on total composition weight, from about 0.05% to about 2% detersive enzyme(s).

Enzyme Stabilizers—If an enzyme or enzymes are included in the compositions, the composition may comprise an enzyme stabilizer. Enzymes can be stabilized using any known stabilizer system like calcium and/or magnesium compounds, boron compounds and substituted boric acids, aromatic borate esters, peptides and peptide derivatives, polyols, low molecular weight carboxylates, relatively hydrophobic organic compounds [e.g. certain esters, diakyl glycol ethers, alcohols or alcohol alkoxylates], alkyl ether carboxylate in addition to a calcium ion source, benzamidine hypochlorite, lower aliphatic alcohols and carboxylic acids, N,N-bis(carboxymethyl) serine salts, (meth)acrylic acid-(meth)acrylic acid ester copolymer and PEG, lignin compound, polyamide oligomer, glycolic acid or its salts, poly hexa methylene bi guanide or N,N-bis-3-amino-propyl-dodecyl amine or salt, and combinations thereof.

Pearlescent Agents—In some aspects, the composition may comprise a pearlescent agent.

In one aspect, the composition, under wash conditions, forms particles having a particle size of 0.005 μm to about 1000 μm, or from about 0.01 μm to about 500 μm, or from about 0.1 μm to about 100 μm.

In one aspect, the composition, under wash conditions, forms a coacervate having an elastic and viscous modulus of from about 10 to about 1,000,000 Pa, or from about 100 to about 200,000 Pa, or from about 500 to about 100,000 Pa in the frequency range 0.1 to 100 rad/s as measured using the Test Methods herein.

In one aspect, the composition may be in the form of an additive. In one aspect, the composition may be a through-the-wash additive wherein the composition has a pH from about 2 to about 12.5, or from about 3 to about 7.

In one aspect, a unit dose system comprising the composition and a water miscible pouch is disclosed, wherein the composition may comprise, based on total weight of the composition, from about 0.01 to about 15% water.

Method of Use

In one aspect, a method of delivering a benefit to a fabric is disclosed, said method comprising the step of a. optionally, washing a fabric;

b. contacting a composition as described above with a source of anionic surfactant to form a mixture having an ACD:CCD ratio of from about 100:1 to about 0.01:1, or from about 10:1 to about 0.05:1 or from about 7:1 to about 0.1:1, or about 2:1 to about 0.1:1 with a fabric;

c. contacting the mixture with said fabric to form a treated fabric;

d. optionally, rinsing said treated fabric.

In one aspect, the method may comprise the step of applying one or more finishing treatments to the treated fabric. The finishing treatment may be selected from the group consisting of drying, pressing, starching, perfuming, and combinations thereof.

In one aspect, the contacting step of the method may be carried out at a temperature of from about 50° C. to about 75° C., or from about 60° C. to about 70° C. In one aspect, the contacting step may be carried out in an aqueous environment.

In one aspect, steps (b) and (c) may be performed at least two times prior to step (d).

In one aspect, the benefit may comprise a benefit selected from the group consisting of color maintenance and/or rejuvenation, cleaning, abrasion resistance, wrinkle removal, pill prevention, anti-shrinkage, anti-static, anti-crease, fabric softness, fabric shape retention, suds suppression, decreased residue in the wash or rinse, improved hand feel or texture, and combinations thereof.

In one aspect, the benefit may comprise color maintenance and/or rejuvenation benefits to fabrics. In this aspect, the treated fabric, as measured when dry according to the Test Methods herein, may have a ΔL value of from about −0.01 to about −15, or from about −0.1 to about −3.0. The method may, in some aspects, be performed until a ΔL value of from about −0.01 to about −15, or from about −0.1 to about −3.0 is achieved.

In one aspect, the source of anionic surfactant may comprise, based on total source of anionic surfactant weight, from about 2% to about 50%, or from about 5% to about 25%, or from about 12% to about 20% of an anionic surfactant. It will be understood to one of skill in the art that the source of anionic surfactant may vary. Suitable anionic surfactants are known in the art, and include those described in U.S. patent application Ser. No. 12/075,333.

In one aspect, the source of anionic surfactant may comprise a conventional detergent. In this aspect, the source of anionic surfactant may be commercially available Tide Free® HE. In this aspect, from about 10 grams to about 100 grams, or from about 50 to about 80 grams of detergent may be used. In one aspect, the conventional detergent may comprise enzymes such as cellulases. The conventional detergent typically has a pH, measured as a 1% solution in distilled water, of from 7.0 to about 12.5, or from about 7.5 to about 11.8, or from about 8.0 to about 11.5.

In one aspect, the source of anionic surfactant may comprise an anionic surfactant comprising a hydrophilicity-lipophilicity balance (HLB) of from about 4 to about 14, or from about 8 to about 10, or about 9.

In one aspect, the source of anionic surfactant may comprise, based on total source of anionic surfactant weight, from about 1.0% to 50%, or from about 7% to about 40% of alkylethoxysulfonate (AES).

In one aspect, the source of anionic surfactant may comprise, based on total source of anionic surfactant weight, less than about 5%, or less than about 10%, or less than about 50% linear alkyl benzene sulfonate (HLAS). In one aspect, the source of anionic surfactant may comprise less than about 10% nonionic surfactant, or less than about 1% nonionic surfactant. In one aspect, the composition may be essentially free of a nonionic surfactant In one aspect, the source of the anionic surfactant may be the fabric itself. In this aspect, residual anionic surfactant on a fabric previously washed with an anionic-containing detergent may provide the source of anionic surfactant.

In one aspect, the ppm of the cationic polymer in the mixture as provided by the composition may be from about 1 to about 5,000, or from about 100 to about 2000, or from about 500 to about 1000.

In one aspect, the composition of step (b), relative to the source of anionic surfactant, may have a cationic charge ratio of about 0.79:1. This is particularly true when the source of anionic surfactant is a conventional detergent.

In one aspect, said composition and said source of anionic surfactant may form particles upon dilution. In this aspect, the anionic surfactant and the cationic polymer may form secondary structures (particles) which may comprise "primary particles" and/or "colloidal particles." For example, upon dilution of 1 part of the composition into 10 parts of wash liquor, in the presence of anionic surfactant, colloidal structures may form, said colloidal structures being less than about 1000 μm on the long axis, or less than about 500 μm on the long axis, or less than about 200 μm on the long axis. In one aspect, the particles may be greater than about 5 μm on the short axis, or greater than about 10 μm on the short axis, or greater than about 25 μm on the short axis.

In one aspect, the composition and said source of anionic surfactant, when diluted at a ratio of about 1:3800 in water, form primary and/or colloidal particles having a size of from about 0.005 to about 1000 μm, or from about 0.01 to about 100 μm.

In one aspect, the composition and the source of anionic surfactant may be combined in a treatment vessel. The treatment vessel may be any suitable reservoir sufficient to dilute the composition and/or the source of anionic surfactant, and may include top loading, front loading and/or commercial washing machines. In one aspect, the treatment vessel may be filled with water or other solvent prior to the addition of the cationic polymer. In one aspect, the cationic polymer and source of anionic surfactant may be combined in the presence of water. In one aspect, the solvent may be water at a temperature of from about 60° F. to about 100° F. The contacting step may comprise submerging and/or saturating the fabric in the mixture, and may be carried out in the presence of agitation. Where an optional rinse step is performed, such step may be performed using any suitable solvent, for example, water, generally at a temperature of from about 60° F. to about 100° F.

In one aspect, the method may be carried out as a service to a consumer. In this aspect, the method may be carried out in a commercial establishment at the request of a consumer.

In one aspect, the method may be carried out at home by the consumer.

In one aspect, a method of delivering a benefit to a fabric comprising a multi-compartment system is disclosed, wherein a multi-compartment system may be used. In this aspect, the first compartment may comprise a composition described above; and the second compartment may comprise a source of anionic surfactant. The multi-compartment system may then dispensed into a wash system, either automatically, via a system that releases the contents during the treatment step mechanically, or, alternatively, via a system under the control of the consumer.

In one aspect, the composition and/or source of anionic surfactant may be provided in a unit dose system wherein the composition and/or source of anionic surfactant may be enclosed in a water miscible pouch. In one aspect, the composition and/or the source of anionic surfactant may comprise, based on total source of anionic surfactant weight, from about 0% to about 15%, or from about 1% to about 10%, or from about 5% to about 8% water. In one aspect, the unit dose system may comprise a pouch having at least two compartments, wherein a first compartment may comprise a source of anionic surfactant, and a second compartment may comprise a composition comprising cationic polymer.

Test Methods

Determination of ΔL—The color and appearance benefit imparted to fabrics can be described, for example, in terms of the refractive index of the fiber before and after treatment of the fabric as defined as a ΔL value as measured via spectrophotometry (for example, via a Hunter spectrophotometer as described herein). A decrease in L value, represented by a negative ΔL value, indicates an improvement (or darkening) in color, which represents a color benefit. In this aspect, the L* value of a fabric (defined above) is determined at the following time points: after application of the Fabric Damaging Protocol to yield a $L_{(damaged)}$ value and after the Fabric Treatment Protocol to yield a $L_{(treated)}$ value. The ΔL value is equal to the $L_{(damaged)}$−the $L_{(treated)}$ value.

Color/Appearance (Subjective)—In one aspect, the improvement in the garment color is measured by the subjective opinion of the user. For example, the user may be asked their opinion on the effectiveness of the treatment using the method described herein by rating the color rejuvenation on a scale of 1 to 4, where 1 is no observable change; 2 shows observable change but color is unacceptable; 3 shows observable change and the color is acceptable; and 4 shows observable change in color and the garment is rejuvenated to a color at or near the original color.

Fabric Damaging Protocol—New black Gildan t-shirts ("garment") (6.1 oz 100% pre-shrunk cotton, double needle stitching, seamless collar, taped neck and shoulders, quarter turned body, Mill Number: 2000; Mill: Gildan; Style number: 0281 GL; Color: Black; Size: Large or extra large, available from TSC Apparel, Cincinnati, Ohio) or a suitable equivalent, are used.

49.6±0.01 grams of commercially available 2× Ultra Tide® detergent is used per cycle. The total garment weight in the washer is 5.5 pounds (or 11 whole Gildan t-shirts). The garments are washed a total of 10 times, with complete drying (approximately 14% residual moisture) in-between each cycle. The wash conditions are as follows: Water: City water having 8.1 gpg average hardness and 1 ppm average chlorine. Washing machine: Kenmore 80 Series, Heavy Duty, Super Capacity Plus, Quiet Pak, 3 speed motor with 4 speed combination, Ultra Rinse System, model number 110.64832400. Cycle: "Heavy Duty Fast/Fast" cycle using 17 gallons (64.35 Liters) water having a temperature of about 60° F. for 12 minutes. One two minute rinse is performed using water having a temperature of about 60° F. The garments are then dried using a Kenmore electric 80 Series, Heavy Duty, Super Capacity Plus, Quiet Pak, model number 110.64832400. The garments are dried for about 60 minutes at a temperature of 186° F. (the "Cotton High" cycle). After the drying step, the garments generally have no noticeable moisture, (about 14% residual water content). The wash and dry cycles are repeated for a total of 10 times unless otherwise indicated. A typical $L_{(damaged)}$ value for a black Gildan T-Shirt is from about 12 to about 14.

Fabric Treatment Protocol—80 grams of the test composition (for example, the composition of Example I) and 80 grams of the Base Detergent Composition are added to a top loading machine containing 17 gallons of city water (about 8 gpg) at 60° F. Test garments are washed in the diluted solution for 12 minutes. The garments are then rinsed using 17 gallons 60° F. city water (about 8 gpg), for two minutes. The garments are then dried until there is no noticeable moisture, i.e., wherein the fabric has a residual moisture content of about 14%.

Dilution under Wash Conditions—Preparation of samples under wash conditions for characterization of particle size and/or rheology is as follows: 50.5 grams of Tide 2×, available from The Procter and Gamble Company (containing 20.06% AES, 2.67% HLAS and 0.80% nonionic surfactant) and 80 grams of sample composition is added to a Kenmore 80 Series, Heavy Duty, Super Capacity Plus, Quiet Pak, 3 speed motor with 4 speed combination, Ultra Rinse System, model number 110.25842400 top-loading washing machine. The mixture is allowed to agitate in the machine using the "Heavy Duty Fast/Fast" cycle (having 17 gallons (64.35 Liters) water at a temperature of about 60° F.), and stopped after 12 minutes. Water quality is 6 gpg. Samples of the solution are extracted immediately after the cycle is stopped for characterization of particle size or rheology as described herein.

Rheology/Adhesive Mapping—The frequency dependence of the material is obtained from a frequency sweep carried out under linear viscoelastic conditions. The structured phase (comprising particles) is separated from wash solutions by centrifugation at a speed and time sufficient to isolate particles as indicated by a substantially clear supernatant. As a result of centrifugation, a viscous gel-like layer comprising coalesced particles forms and separates as the bottom phase. A low viscosity supernatant is present. The supernatant is decanted to isolate the gel-like layer for further testing. The linear viscoelastic region is identified as follows: using a stress-controlled rheometer equipped with parallel plate geometry (12 mm, or 25 mm; selected based on modulus of the gel phase, as readily understood by one of skill in the art), a dynamic stress sweep, where G' (elastic modulus) and G" (viscous modulus) are measured as a function of stress, is run at a fixed frequency 1 rad/s. The linear viscoelastic region is defined as the stress range over which G' and G" are constant, i.e. independent of stress. A dynamic frequency sweep, where G' and G" are measured as a function of frequency between 0.1 and 100 rad/s is then run at a stress within this linear viscoelastic regime. A viscoelastic "window" is then formed by plotting G' on the y-axis and G" on the x-axis, with the upper right corner of the window corresponding to the high frequency point i.e. G"(100 rad/s), G'(100 rad/s) and the lower left corner corresponding to the low frequency point i.e. G"(0.1 rad/s), G'(0.1 rad/s).

EXAMPLES

TABLE I

Compositions-Examples I-III.

| | % Active | | |
|---|---|---|---|
| Component Ingredient | Example I | Example II | Example III |
| Polyquaternarium 6, CAS# 26062-79-3 | 4 | 6 | 8 |
| Cartafix ® TSF, available from Clariant, Basle, Switzerland | 4 | — | — |
| Lauryl trimethyl ammonium chloride[1] CAS # 112-00-5 | 3 | 3 | 3 |
| Formic Acid, CAS # 64-18-6 | 0.1 | 0.1 | 0.1 |
| DI Water | | Balance | |
| pH | | 3.0 ± 0.3 | |

Example IV

Providing a Benefit in a Commercial Setting

A consumer provides the colored garments/fabrics desired to be treated. The fabrics may be optionally pre-conditioned (via wetting, for example) or pre-cleaned using a conventional detergent or other light cleaning. The fabric is added to a commercial front loading machine, Unimac Model Number UW60PV, having a 60 pound capacity. From about 10 to about 50 pounds of consumer provided fabric is added to the front loading machine. Approximately 15 gallons of water is added, at a temperature of about 60° F.

After addition of the water, 80 grams of commercially available Tide Free® HE 2× (approximately 15% AES) is added to the water and fabric mixture. 240 grams of the composition of Example I is then added separately. The composition can alternatively be added via a pump mechanism attached to the machine. The clothing is then washed for about 12 minutes, and rinsed using one or more normal rinse cycles for approximately 2 minutes each at about 60° F. The volume of the rinse cycle water is similar to that of the wash cycle. The fabrics are then subjected to one or more finishing treatment elected by the consumer, including steam pressing, drying, application of perfume, starching and/or additional fabric finishing treatments. The garments are then returned to the consumer.

Example V

Providing a Benefit in a Commercial Setting

A consumer provides the colored garments/fabrics desired to be treated. The fabric is added to a top loading machine (Kenmore 800 Series) having about a 17 gallon capacity. From about 4 to about 6 pounds of fabric is added to the machine. About 17 gallons of water having a temperature of 60° F. is added.

After addition of the water, 66.7 g of the commercially available Tide with a Touch of Downy 2× (approximately 30% AES) is added. 80 g of the composition of Example I is added. The clothing is washed for about 12 minutes, and then subjected to a rinse step comprising about 17 gallons of water having a temperature of from about 60° F. to about 100° F. The fabrics are then subjected to one or more finishing treatments, including steam pressing, drying, application of perfume, starching and/or additional fabric finishing treatments. The garments are then returned to the consumer.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm"

Every document cited herein, including any cross referenced or related patent or application, is hereby incorporated herein by reference in its entirety unless expressly excluded or otherwise limited. The citation of any document not an admission that it prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed:

1. A method of delivering a color maintenance and/or rejuvenation benefit to a fabric comprising the steps of:

a. washing a fabric;

b. combining a fabric care additive composition having an acidic pH comprising, based on total composition weight, from about 5% to about 20% of a cationic polymer, said fabric care additive composition further comprising a cationic surfactant, wherein said cationic polymer has a charge density of from about 0.05 meq/g to about 25 meq/g at a pH of from about 2 to about 11 and said cationic polymer is a polymer selected from the group consisting of alkylamine epichlorohydrin polymers, homopolymers of diallyldimethyl ammonium chloride, copolymers of diallyldimethyl ammonium chloride, and combinations thereof, in the presence of water in a washing machine with a conventional detergent as a source of anionic surfactant to form a mixture having an ACD:CCD ratio of from about 2:1 to about 0.1:1;

c. contacting said mixture with said fabric to form a treated fabric;

d. rinsing said treated fabric;

e. applying one or more finishing treatments selected from the group consisting of drying, pressing, starching, perfuming, and combinations thereof to the treated fabric wherein said method is carried out as a service to a consumer.

2. A method according to claim 1, wherein said treated fabric, as measured when dry, has a $\Delta L$ value of from about −0.01 to about −15.

3. A method according to claim 1, wherein the source of anionic surfactant comprises, based on total source of anionic surfactant weight, from about 2% to about 50% anionic surfactant.

4. A method according to claim 1 wherein the source of anionic surfactant comprises, based on total source of anionic surfactant weight, from about 1.0% to about 50% of alkylethoxysulfonate.

5. A method according to claim 1, wherein the source of anionic surfactant comprises, based on total source of anionic surfactant weight, less than about 5% linear alkylbenzene sulfonate.

6. A method according to claim 1, wherein the source of anionic surfactant comprises, based on total source of anionic surfactant weight, less than about 10% nonionic surfactant.

7. A method according to claim 1, wherein the ppm of the cationic polymer in the mixture is from about 1 to about 5,000.

8. A method according to claim 1, wherein the cationic charge density ratio of said composition to said source of anionic surfactant is about 0.79:1.

9. A method according to claim 1, wherein the cationic surfactant is lauryl trimethyl ammonium chloride.

10. A method according to claim 1, wherein the ppm of the cationic polymer in the mixture as provided by the fabric care additive composition is from about 100 to about 2000.

11. A method according to claim 1, wherein the fabric care additive composition is essentially free of organosilicones.

12. A method of delivering a color maintenance and/or rejuvenation benefit to a fabric comprising the steps of:

a. optionally washing a fabric;

b. combining a fabric care additive composition having an acidic pH comprising, based on total composition weight, from about 5% to about 20% of a cationic polymer, wherein said cationic polymer has a charge density of from about 0.05 meq/g to about 25 meq/g at a pH of from about 2 to about 11 and said cationic polymer is a polymer selected from the group consisting of alkylamine epichlorohydrin polymers, homopolymers of diallyldimethyl ammonium chloride, copolymers of diallyldimethyl ammonium chloride, and combinations thereof, in the presence of water with a conventional detergent as a source of anionic surfactant to form a mixture having an ACD:CCD ratio of from about 7:1 to about 0.1:1;

c. contacting said mixture in an aqueous environment with said fabric to form a treated fabric;

d. optionally rinsing said treated fabric;

e. optionally applying one or more finishing treatments selected from the group consisting of drying, pressing, starching, perfuming, and combinations thereof to the treated fabric.

13. A method according to claim 12, wherein the fabric care additive composition is provided in a unit dose system wherein the fabric care additive composition is enclosed in a water miscible pouch.

14. A method according to claim 13, wherein the water miscible pouch has at least two compartments, wherein a first compartment comprises the source of anionic surfactant, and the second compartment comprises the fabric care additive composition.

15. A method according to claim 12, wherein the fabric care additive composition and the source of anionic surfactant, when diluted at a ratio of about 1:3800 in water, form primary and/or colloidal particles having a size of from about 0.01 μm to about 100 μm.

16. A method according to claim 12, wherein the fabric care additive composition further comprises a cationic surfactant.

17. A method according to claim 16, wherein the cationic surfactant is lauryl trimethyl ammonium chloride.

18. A method according to claim 12, wherein the fabric care additive composition consists essentially of cationic polymer, cationic surfactant, formic acid, and water.

19. A method according to claim 12, wherein the fabric care additive composition is essentially free of organosilicones.

20. A method according to claim 12, wherein the mixture is essentially free of organo silicones.

* * * * *